United States Patent [19]

Smart et al.

[11] Patent Number: 5,035,353

[45] Date of Patent: Jul. 30, 1991

[54] AUTOMATIC RIVETING MACHINE

[75] Inventors: Charles F. Smart, Danbury; Anthony D'Aquila, Trumbull, both of Conn.

[73] Assignee: Emhart Inc., Newark, Del.

[21] Appl. No.: 598,921

[22] Filed: Oct. 16, 1990

Related U.S. Application Data

[63] Continuation of Ser. No. 445,077, Dec. 1, 1989, Pat. No. 4,972,985.

[51] Int. Cl.[5] ..... B21J 15/10; B21J 15/28

[52] U.S. Cl. ..... 227/2; 227/3; 227/112

[58] Field of Search ..... 227/2, 3, 112, 116, 227/118

[56] References Cited

U.S. PATENT DOCUMENTS 4,754,643 7/1988 Weeks, Jr. et al. ..... 72/391
4,765,175 8/1988 Denham et al. ..... 72/391
4,790,470 12/1988 Miles ..... 227/1
4,811,881 3/1989 Heck ..... 227/4

OTHER PUBLICATIONS

Fastec '85, Conference Proceedings, Oct. 8-11, 1985, Atlanta, Ga.

*Primary Examiner*—Frank T. Yost
*Assistant Examiner*—John M. Husar
*Attorney, Agent, or Firm*—Spencer T. Smith

[57] ABSTRACT

A vacuum pulls a spent mandrel through a gun bore and into a collection tube which discharges into a collector. Gun operation and mandrel entry into and departure from the collection tube are sensed and blockage of the mandrel within the collection tube and the jamming of the mandrel in the rivet gun are determined and signalled to the operator. The cycle immediately continues when the mandrel is cleared.

2 Claims, 3 Drawing Sheets

AUTOMATIC RIVETING MACHINE

This is a continuation of co-pending application Ser. No. 445,077, filed on Dec. 1, 1989, now U.S. Pat. No. 4,972,985.

The Present invention relates to automatic riveting machines such as disclosed in U.S. Pat. Nos. 4,747,294 and 4,754,643 and more particularly to the handling of spent mandrels created when rivets are set by such machines.

In rivet setting machines the operator sets a rivet held in the nose of the rivet tool by pulling the trigger. The remaining spent mandrel is drawn through the tool and through a collection tube (which includes a vacuum transducer) into a collection box. A proximity switch senses the spent mandrel just before it enters the collection box and enables the cycle to continue. If a predetermined period of time passes following trigger operation without the proximity sensor sensing the passage of the mandrel, the system stops. In such prior art systems the operator would have to check the jaws to see if the spent mandrel was jammed in the jaws, then check the collection tube to make sure that the spent mandrel was not blocked in the tube and lastly check the vacuum transducer to check for a mandrel jammed there. Then, he would have to restart the stopped system.

It is accordingly an object of the present invention to minimize downtime by immediately continuing the cycle whenever a spent mandrel which is either jammed in the gun jaws or blocked in the collection tube becomes freed and is drawn to the collection box.

Other objects and advantages of the present invention will become apparent from the following portion of this specification and from the accompanying drawings which illustrate in accordance with the mandate of the patent statutes, a presently preferred embodiment incorporating the principles of the invention.

Referring to the drawings.

Figure 1:
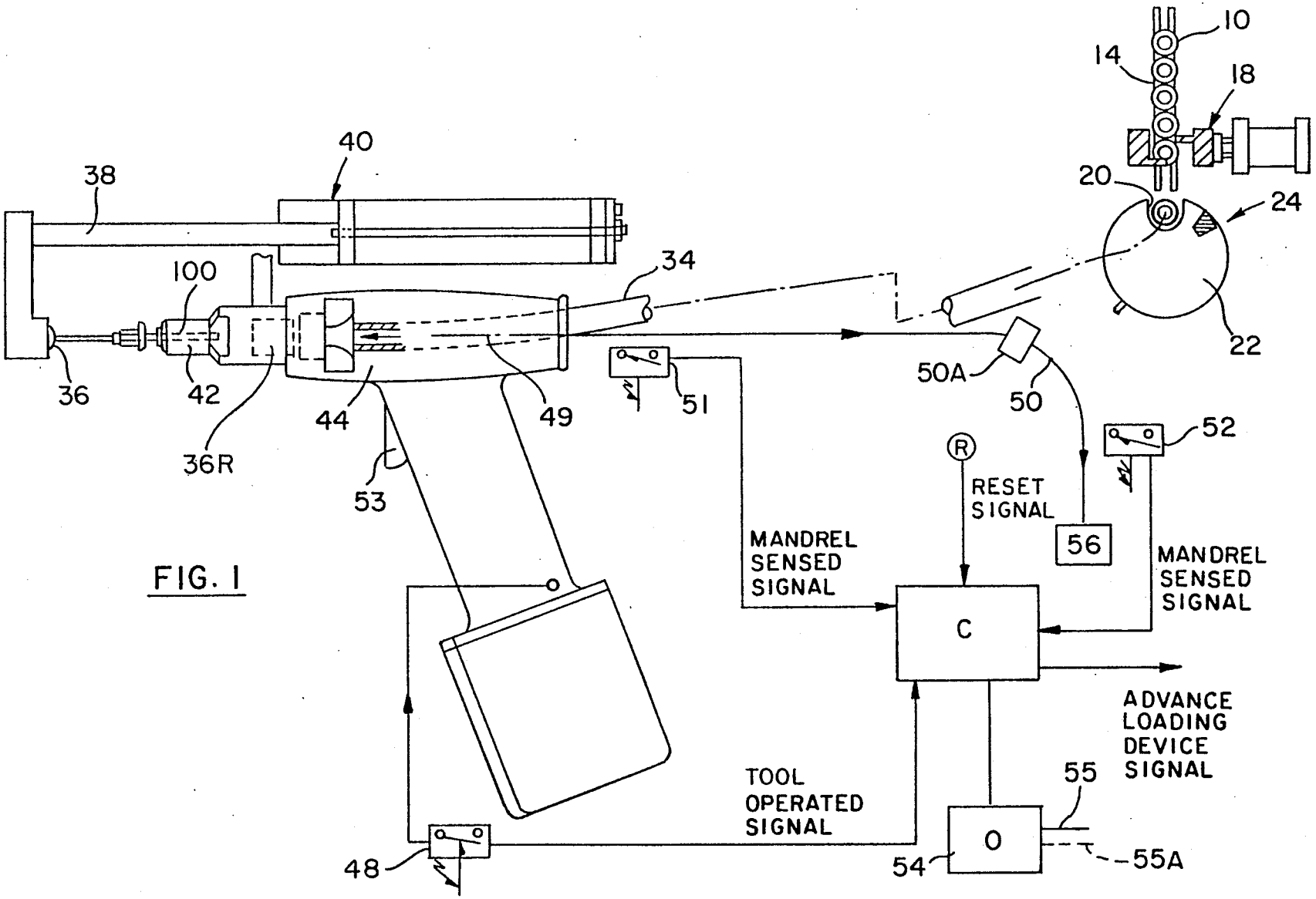
FIG. 1 is a schematic representation of a portion of an automatic riveting machine made in accordance with the teachings of the present invention.
Figure 2:
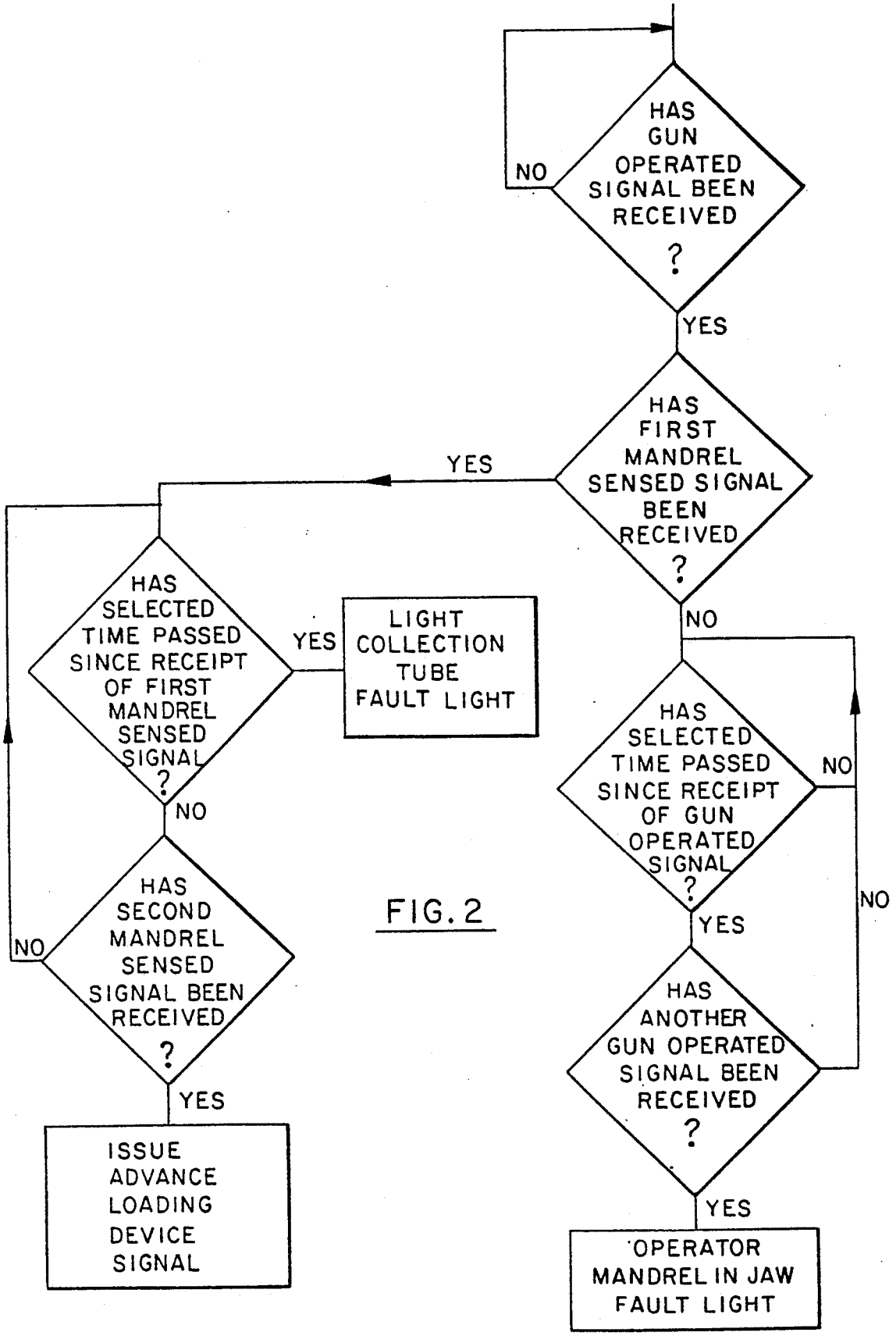
FIG. 2 is part of a flow chart illustrating the control of rivet feed to the rivet gun of the automatic riveting machine illustrated in FIG. 1.
Figure 3:
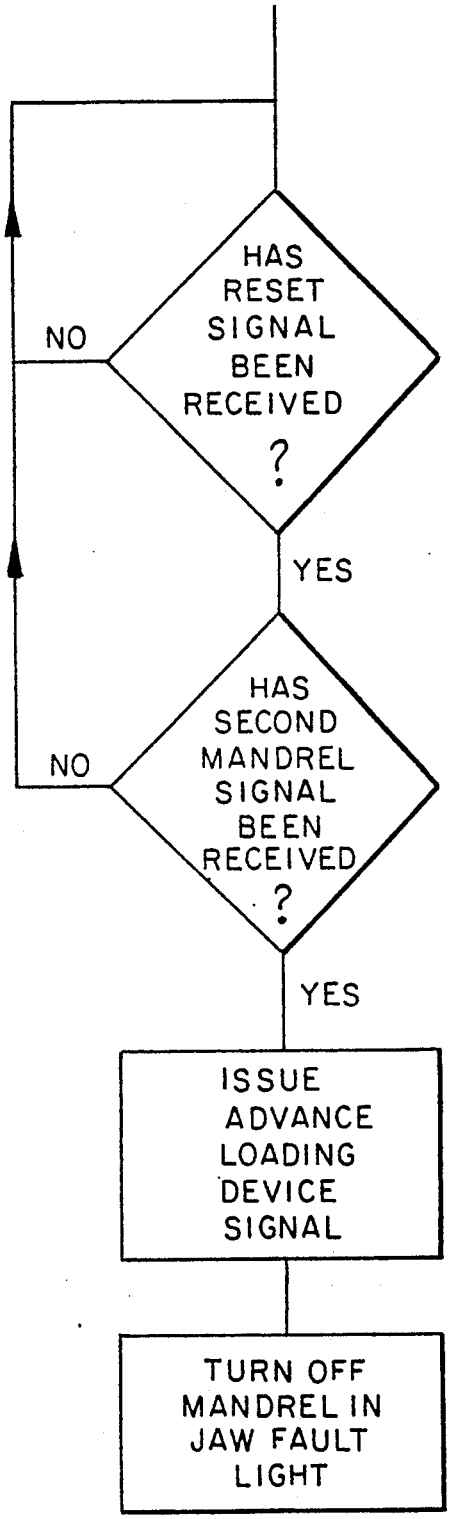
FIG. 3 is another part of the flow chart.

Rivets 10 are released, one at a time, from a feed track 14 by a gating mechanism 18 and will be received within an axial channel 20 defined in the cylindrical rotor 22 of an escapement mechanism 24. The rotor indexes 90 degrees from its receiving orientation to its transfer orientation and air under pressure (not shown) is then connected to blow the rivet through the rivet feed tube 34 to the retracted nesting bushing (shown in phantom) 36R of the extendable pivot arm 38 of the presenting device 40. The nesting bushing 36 is under a vacuum which draws the rivet into the bushing. The arm 38 is extended and pivoted to align the rivet with the aperture 100 of the nose 42 of the rivet tool 44 whereupon vacuum is removed and pressure is applied to blow the rivet into the aperture 100 of the rivet tool 44. As soon as a rivet is transferred from the nesting bushing 36 to the nose 42, the loading arm 38 pivots away and is retracted to the rivet load position where another rivet will be transferred to the nesting bushing.

Air flow switch 48 senses tool operation (the trigger 53 is pulled) and generates a Tool Operated Signal which indicates that a rivet has been set. When the operator releases the trigger the jaws release the spent mandrel. If the spent mandrel is properly released by the jaws of the tool 42 and withdrawn from the barrel 49 of the tool through the mandrel collection tube 50 (which includes a vacuum transducer 50A), sensors 51 and 52 at either end of the collection tube will sense the passing mandrel and issue Mandrel Sensed Signals. The controller will then issue an Advance Loading Device Signal to operate the loading device 40 to transfer the next rivet to the tool.

Should the spent mandrel get blocked in the collection tube 50, the first sensor 51 will sense the mandrel but the second sensor 52 will not. A timer is started by the Mandrel Sensed Signal issued by the first sensor and times out after a period of time sufficient for the mandrel to travel the length of the collection tube. The controller C will then operate a fault light 54 to issue an intermittent fault signal 55 to advise the operator that a mandrel is blocked in the collection tube 50. The operator can then straighten out the tube in an attempt to free the blockage so that the mandrel will be drawn through the remaining portion of the tube and discharged into the collector 56.

When the freed mandrel passes the second sensor 52, the controller will receive the second Mandrel Sensed Signal. When the operator hits the reset button R to send a reset signal to the controller C the controller receiving both the Reset Signal and the Mandrel Sensed Signal will issue an Advance Loading Device Signal. In the event the spent mandrel is still caught in the transducer 50A the second Mandrel Sensed Signal will not have been received by the controller and the system will continue to be disabled until the problem is cleared.

If the tool is operated but the first sensor fails to sense the spent rivet within a predetermined period of time the system may be perfectly operational (the operator may not have released the trigger and hence be holding the spent mandrel in the jaws) or a spent mandrel may be stuck in the jaw or jaws slopped creating a partially set rivet. To provide the controller with enough data to determine that there is a jaw fault the operator again operates the tool. The controller will, immediately following the repeat operation of the tool, operate the fault light 54 to issue a continuous fault signal 55A to advise the operator that the spent mandrel is stuck in the jaws. If as a result of the repeat operation a spent mandrel leaves the tool the system the spent mandrel will be sensed by the first sensor and within the prescribed time will be sensed by the second sensor. The cycle will accordingly continue as above described. If the spent rivet is jammed in the nose the operator will free the jam whereupon the spent mandrel will be pulled back to the mandrel collection tube and the system will also continue as above described.

We claim:

1. A rivet setting machine comprising a rivet tool, a loading device for delivering a rivet to the rivet tool, trigger means for operating said rivet tool to set a rivet, whereby a spent mandrel will be formed, means for collecting the spent mandrel including a conduit within said rivet tool, a collection box and a collection tube connecting said rivet tool conduit and said collection box, and vacuum means for pulling a spent mandrel from said rivet tool, through said collection tube and into said collection box, means for providing operator usable data indicating that a spent mandrel is blocked within said collection tube including first means for sensing rivet tool operation, second means for sensing the entry of a spent mandrel into said collection tube and third means for sensing the departure of the spent mandrel from said collection tube and for issuing a sensed mandrel signal, means for determining that said first and second sensing means have sensed tool operation and mandrel entry into said collection tube but that said third means has not sensed the departure of said mandrel from said collection tube within a predetermined period of time following the sensing of said spent mandrel by said second sensing means thereby determining the spent mandrel is blocked in said collection tube, fault identification means operated when said determining means so determines that a spent mandrel is blocked in said collection tube for informing the operator of the fault and for preventing the actuation of said loading device, and means for actuating said loading device in the event that the spent mandrel is sensed by said third sensing means following operation of said fault identification means including a reset button for issuing a reset signal when operated and means for issuing an actuate loading device signal in the event said third sensing means has issued a sensed mandrel signal when said reset button issues said reset signal.

2. A rivet setting machine comprising a rivet tool, a loading device for delivering a rivet to the rivet tool, trigger means for operating said rivet tool to set a rivet, whereby a spent mandrel will be formed, means for collecting the spent mandrel including a conduit within said rivet tool, a collection box and a collection tube connecting said rivet tool conduit and said collection box, and vacuum means for pulling a spent mandrel from said rivet tool, through said collection tube and into said collection box, first means for sensing rivet tool operation, second means for sensing the entry of a spent mandrel into said collection tube within a selected period of time following the sensing of rivet tool operation by said first sensing means, means for preventing the operation of said loading device if said second means fails to sense the entry of the spent mandrel within said selected period of time, means for determining whether the spent mandrel is stuck in said rivet tool when said second means fails to sense the entry of the spent mandrel within said selected period of time including means for determining whether a spent mandrel is sensed by said second sensing means within said selected period of time following the sensing of a second tool operation by said first sensing means, fault identification means for informing the operator that the spent mandrel is stuck in the tool in the event said determining means determines that a spent mandrel has not been sensed within said selected period of time and means for permitting the operation of said loading device if said determining means determines that a spent mandrel has been sensed within said selected period of time.

* * * * *